US007030595B2

(12) United States Patent
Akita

(10) Patent No.: US 7,030,595 B2
(45) Date of Patent: Apr. 18, 2006

(54) VOLTAGE REGULATOR HAVING AN INVERSE ADAPTIVE CONTROLLER

(75) Inventor: Shinichi Akita, Tokyo (JP)

(73) Assignee: Nanopower Solutions Co., Ltd., Tokyo (JP)

( * ) Notice: Subject to any disclaimer, the term of this patent is extended or adjusted under 35 U.S.C. 154(b) by 45 days.

(21) Appl. No.: 10/910,956

(22) Filed: Aug. 4, 2004

(65) Prior Publication Data

US 2006/0028189 A1 Feb. 9, 2006

(51) Int. Cl.
*G05F 1/40* (2006.01)

(52) U.S. Cl. ..... 323/280; 323/281

(58) Field of Classification Search ..... 323/280, 323/281, 315, 316
See application file for complete search history.

(56) References Cited

U.S. PATENT DOCUMENTS

| | | | | |
|---|---|---|---|---|
| 3,870,896 A | | 3/1975 | Kiko | 307/34 |
| 4,315,207 A | | 2/1982 | Apfel | 323/284 |
| 4,327,319 A | | 4/1982 | Swisher et al. | 323/303 |
| 4,535,276 A | | 8/1985 | Yokobori | 318/254 |
| 5,055,767 A | | 10/1991 | Nelson | 323/285 |
| 5,130,579 A | | 7/1992 | Thomas | 307/520 |
| 5,408,173 A | | 4/1995 | Knapp | 323/285 |
| 5,631,598 A | | 5/1997 | Miranda et al. | 327/540 |
| 5,668,464 A | | 9/1997 | Krein et al. | 323/259 |
| 5,861,736 A | * | 1/1999 | Corsi et al. | 323/273 |
| 5,889,393 A | | 3/1999 | Wrathall | 323/282 |
| 6,246,221 B1 | | 6/2001 | Xi | 323/280 |
| 6,304,131 B1 | | 10/2001 | Huggins et al. | 327/538 |

FOREIGN PATENT DOCUMENTS

| | | |
|---|---|---|
| JP | 04-263303 | 9/1992 |
| JP | 05-035344 | 2/1993 |
| JP | 05-204476 | 8/1993 |
| JP | 08-272461 | 10/1996 |
| JP | 2000-047738 | 2/2000 |
| JP | 2000-284843 | 10/2000 |
| JP | 2001-195138 | 7/2001 |
| JP | 2001-339937 | 7/2001 |

OTHER PUBLICATIONS

"Analog Integrated Circuit Design" by Johns, et al., 1997, pp. 223-224.

* cited by examiner

*Primary Examiner*—Shawn Riley
(74) *Attorney, Agent, or Firm*—Ohlandt, Greeley, Ruggiero & Perle, L.L.P.

(57) ABSTRACT

A low drop-out (LDO) voltage regulator that has high a PSRR (Power Supply Ripple Rejection) performance and a high load regulation with low current consumption is disclosed. The voltage regulator doses not require any high gain error amplifier that may cause instability in the voltage regulator. A voltage-controlled current-feedback is presented that generates an inverse phase signal and compensation voltage for a ripple noise and dropout voltage, respectively. The voltage-controlled current-feedback generates a negative voltage slope with regard to the power supply voltage, which can cancel the ripple noise at the output terminal. The current-feedback creates a positive coefficient voltage with regard to the load current, which compensates the voltage drop caused by parasitic resistances.

2 Claims, 16 Drawing Sheets

VOLTAGE REGULATOR HAVING AN INVERSE ADAPTIVE CONTROLLER

The present invention relates to low-dropout (LDO) voltage regulators being integrated in semiconductor devices. More particularly, the present invention relates to LDO voltage regulators having a high PSRR (Power Supply Ripple Rejection) performance and a superior load regulation.

BACKGROUND OF THE INVENTION

Not only handy equipment but also every kind of electric equipment incorporates several voltage regulators. Those are applied for digital circuits, high frequency circuits and analog circuits. As an example, in a cellular phone, a very high power supply ripple rejection is required for a RF transmitting circuit because poor ripple rejection results in poor clearness of voice conversation. Even in digitally coded wireless equipments, a transmission circuit and a reception circuit apply analog modulation and demodulation, respectively, whereby ripple noise affects the error rate of data communication. According to the prior art, a high ripple rejection ratio about −80 dB is feasible with enough operation current of a few 100 uA. There are many proposed inventions, but very few proposals cover a high ripple rejection ratio with very low operation current.

FIG. 1 shows a block diagram of a prior CMOS type voltage regulator. The voltage regulator in FIG. 1 has a first power supply terminal 1 and a second power supply terminal 2 as well as a reference voltage circuit 50 generating a reference voltage Vref. An error amplifier 100 multiplies an error voltage from the reference voltage, a bias current generator 60 provides operation current for the error amplifier 100, an output buffer 30 generates a voltage output and an output voltage divider 40 attenuates the output voltage for sensing an error. FIG. 2 shows a circuit diagram for the block diagram shown in FIG. 1.

In FIG. 2 the error amplifier 100 is a two-stage amplifier consisting of a differential amplifier 10 as a first stage and a phase inverting amplifier 20 as a second-stage. The reference voltage generator 50 is connected to an input terminal N1 of the error amplifier and the output voltage divider 40 is connected to the second input N2.

FIG. 3 shows the DC characteristic of the voltage regulator circuit in FIG. 2. It illustrates the supply voltage dependence of the reference voltage and the output voltage.

The horizontal axis indicates the supply voltage Vdd. A curve 31 shows the operation current of the error amplifier 100, while curves 32, 33 and 34 show the gate voltage of the output buffer P4, the output voltage, and the reference voltage, respectively.

FIG. 4 shows 10,000-times expanded scale of the DC characteristic extracted from FIG. 3. Curves 41 and 42 indicate the output voltage and the reference voltage, respectively.

The curve 42 in FIG. 4 shows that it has positive coefficient and that it increases as the supply voltage rises. The particular nature of the reference voltage affects the PSRR performance in the low frequency range.

A. Equations for the Prior Regulator Circuit

Generally, the PSRR (Power Supply Ripple Rejection) is defined as a voltage variation caused by a specific voltage change of the supply voltage, for instance by 1 volt.

The output voltage Vout of the prior voltage regulator circuit is introduced as follows, $$Vout=Vref\times(Av/1+K\times Av)+So \quad (1)$$

wherein:

Vref=reference voltage generator 50,

Av=open loop voltage gain of the error amplifier 100,

K=dividing ratio of the output voltage divider 40;

So=system offset voltage of the error amplifier 100;

The first term Vref depends on the supply voltage, and the rate of change is expressed by the following equation, $$D(Vref)=(dVref/dv)/K$$

Generally, D(Vref) has a positive polarity or, in other words, the reference voltage Vref increases as the supply voltage Vdd increases. The dividing ratio K of the output voltage divider 40 is always K<1. Filtering can eliminate the ripple noise "DVref" derived from the reference voltage. However, such a filter is not integrated in a monolithic semiconductor chip, since a fairly large time constant is required due to the wide frequency spectrum of the ripple noise on the reference voltage Vref.

The coefficient K is expressed as K=R1/(R1+R2), wherein R1 and R2 indicate resistors in the output voltage divider 40 shown in FIG. 2. When each resistor R1 and R2 is fabricated from a poly-silicon material, the supply voltage dependency is negligible small. The coefficient K defines the output voltage and it is designed in a limited range such as from 0.2 to 0.8. Therefore, it contributes to the ripple rejection slightly.

The system-offset voltage So is inevitably generated from a multi-stage amplifier, it is not adopted in a prior equation. It is introduced and substantiated by experimental data. The system offset has a supply dependency usually with a positive coefficient, while if a negative coefficient becomes feasible, it will play an important role in the equation (1).

The supply voltage dependency of So, D(So) is expressed as D(So)=dSo/dv.

The open loop gain Av has also a supply voltage coefficient, the rate of change D(Av) is derived as the following differential function;

$$D(Av)=(dAv/dv)/(1+K\times Av)\hat{}2,$$

wherein "^2" indicates a square operation or the raising of a certain number to the second power.

For example, Av=10,000 times (80 dB) at Vdd=4 v, Av=12,000 times at Vdd=5 v, K=0.5, Vref=1.2 v, resulting in:

$$D(Av)=96uV(-80.5\ dB)$$

It is understood that −80.5 dB is not negligible small to attain the figure of −90 dB, for instance.

Then, the total ripple voltage is summarized as follows;

$$D(Vout)=D(Vref)+Vref\times D(Av)+D(So) \quad (2)$$

B. Stability of the Voltage Regulator Circuit

For the voltage regulator incorporated with a two-stage error amplifier and the output buffer as a $3^{rd}$ amplifier, the stability is a very critical factor. Let the voltage gain of the $1^{st}$ stage, $2^{nd}$ stage and $3^{rd}$ stage be Av1, Av2 and Av3, respectively, whereby the total voltage gain is:

$$Av=Av1\times Av2\times Av3$$

For a normalization, let the voltage gain of the stage "i" amplifier be Avi, whereby $$Avi=Gmi*Zoi \quad (3),$$

wherein Gmi and Zoi indicate a conductance and an output impedance of the stage "i"-amplifier, respectively. The output impedance will be $$Zoi=Rpi//Rni//Coi,$$

wherein Rpi//Rni//Coi expresses the parallel impedance of the output resistance of the P-FET in the i-stage amplifier and the output resistance of the N-FET in the i-stage amplifier as well as the output parasitic capacitance of the i-stage amplifier in FIG. 2, whereby $$Rpi=A(Li/Idi)*SQR(Vdgi+Vtpi) \quad (4)$$

wherein "A" is a coefficient, A=5*10^6SQR(V/m), being referenced from the following reference text book. "ANALOG INTEGRATED CIRCUIT DESIGN, BY JOHNS and MARTIN, JOHN WILEY & SONS, INC., PAGE 223–224"

The conductance Gmi is represented by the following formula, $$Gmi=SQR\{2*up*Cox*(Wi/Li)*Idi\} \quad (5)$$

wherein "up", "Cox", "Wi", "Li" and "Idi" represent a carrier mobility, a unit capacity of a gate oxide, channel width of Pi, channel length of Pi and drain current of Pi, respectively, whereby Pi means the P-FET of an i-stage amplifier.

Then, studying the frequency characteristics of the voltage regulator, it may be seen that each stage has a pole at a frequency Fpi, whereby $$Fpi=½pai*Zoi \quad (6)$$

The output of stage "i"-amplifier drops off at the frequency Fpi by minus 6 dB per octave.

B1. Intermediate Summary

According to the equation (2), higher voltage gain contributes to reduced ripple noise. From the equation (5), it is assumed that the larger the drain current, the higher the voltage gain. However, the equation (4) and (3) show that the less the drain current, the higher the output impedance that increases the voltage gain. On the other hand, the equation (4) and (6) lead to another contradiction that a less drain current results in a lower pole frequency that limits the voltage gain in the high frequency area.

B2. Zero Frequency

There are two major zero points in the voltage regulator in FIG. 2. The voltage gain increases at the zero-point frequency by the rate of +6 dB per octave. The first zero-point frequency is determined by an output condenser C3 and an output load resistance R3. The zero-point frequency is expressed as follows, $$Fz1=½pai*R3*C3 \quad (8)$$

The decoupling output condenser C3 ranges from 1000 pF to 10 uF for instance. The output resistance R3 varies very widely such as from 10 ohm to 100 Kohm, for instance, depending upon the load current.

The second zero-point frequency is also very important for achieving stability. The second zero-point frequency is determined by the output condenser C3 and two parasitic resistances. A gold bonding wire that connects between a bonding pad and an outer lead frame has a parasitic resistance, and a contact-hole has a parasitic resistance. The output parasitic resistance Rog generally ranges from 50 mohm to 200 ohm. Another parasitic resistance is the equivalent series resistance (ESR) of the output-decoupling condenser C3. Then, the second zero-point frequency is expressed as follows, $$Fz2=½pai*(Rog+ESR)*C3 \quad (9),$$

wherein, for instance, Rog=200 mohm, ESR=20 mohm, Fz1=0.15 Hz to 1.5 Mhz, Fz2=72 Khz to 7.2 Mhz The first zero-point frequency Fz1 is moving depending upon the output load current. When the load current is fairly large, the zero frequency Fz1 is shifted to a high frequency region. In case of a light or no load condition, it moves to a very low frequency to cause a large phase delay, which may cause instability in the voltage regulator.

The second zero-point frequency Fz2 does not depend on the load current, being isolated from the load current. The Equivalent Series Resistance (ESR) of the decoupling condenser C3 has to be taken into account, varying depending on the type of condenser. For instance, the ESR of a chemical condenser ranges from a few ohms to a few 10 ohms. That of a tantalum condenser is in the order of a few ohms. A ceramic condenser gives 1 through 100 milliohms. Therefore, an unsuitable condenser may cause the voltage regulator to be unstable.

Since the second zero frequency Fz2 dominates the phase delay around 180 degrees, it is also critical for achieving voltage regulator stability.

B3. Concrete Example of Stability vs. Poles and Zeros

As for the pole frequency Fpi, it is said that pole frequencies separated over 10 times from each other result in good stability. For better understanding, the following component values and calculated pole frequencies are listed as an example.

According to the equation (6), the first pole Fp1 is calculated in the following way:

Ro1=150 Kohm to 300 Kohm, output resistance of the first stage amplifier 10.

Co1=0.1 pF to 0.2 pF, output capacitance of the first stage amplifier 10.

Fp1=½pai×Co1×Ro1=several 100 Khz to a few Meg Hz

The first pole Fp1 has a fixed frequency. Though the parasitic capacitor Co1 is very small, but has to be taken into account, an extra additional capacitor connected between the gate terminal and the drain terminal of the PFET P3 in FIG. 2 can have a large effect on the phase compensation for achieving good stability. The position of the first pole Fp1 is suitable for additional phase compensation to achieve good stability. However, it should be noted that the phase compensation by the first pole Fp1 adjustment degrades the PSRR performance very much. The present invention resolves enough phase compensation producing high stability without any degradation of the PSRR performance, due to the cancellation action by the voltage controlled current feedback connected to the signal generator mentioned later.

The second pole Fp2 is calculated as follows,

Ro2=50 Kohm to 100 Kohm

Co2=150 pF to 200 pF, Co2 consists of the gate capacitance of the output buffer FET P4 and an additional condenser C5 for phase compensation.

Fp2=a few KHz to 20 KHz

The second pole frequency Fp2 is a fixed value, however, it becomes critical corresponding in connection with Fp3 as mentioned later.

The third pole Fp3 is calculated as follows,

R3=1 ohm, when Iout=100 mA and Vds=100 mV.

R3=100 Kohm, when Iout=1 uA and Vds=100 mV.

C3=1 uF

Fp3=1.5 Hz at no load or light load.

Fp3=150 Khz at large load or large load current.

When the output load is null or very light, the 3rd pole frequency is very smaller than FP2 and a phase shift begins from the low frequency onwards that may cause less phase margin. A low resistance of R3 or higher idling current through the output buffer transistor P4 causes a higher pole frequency Fp3 that improves the stability but sacrifices low current operation. It is one reason why the prior regulator circuit is not suitable for both of low power operation and good stability.

When the output load is heavy or in case of high output current, the third pole frequency Fp3 is close to the second pole frequency Fp2. If the voltage gain is large enough, when Fp3 and Fp2 are close to each other, that may cause instability. To avoid the instability, Fp2 must be moved toward lower frequency for decreasing the voltage gain by increasing the capacitance of the extra-capacitance C5. However, this produces a poor PSRR performance in the high frequency region because the ripple noise passes through the capacitance C5 from the node "PD" to the output terminal. Besides, the increased capacitance of C5 requires a higher drive current of the 2nd stage amplifier 20 in FIG. 2, that means a greater idling current of the output transistor P3.

Thus, according to the prior art, a sufficient operation current and enough idling current are required to attain high PSRR performance in the high frequency band, such as −80 dB at 10 kHz.

C. Load Regulation

Load current drops the output voltage of the voltage regulator. Load regulation indicates the dropout percentage of the output voltage caused by predetermined load current range. The output voltage is expressed in the following way, $$Vout=VO-(Rog+Ron)\times Io \quad (1a),$$

wherein VO=the output voltage at no load, Io=load current, Rog is an equivalent parasitic resistance at the output shown in FIG. 2, Ron is an ON state resistance of PFET P4, and P4 is characteristically in the triode region the on resistance expressed by the well-known equation as follows, $$Ron=(2\ L/KpW)\{½(Vsg-Vth)-Vds^2\},$$

wherein L=channel length, W=channel width, Kp=conductance figure, Vgs=gate source voltage, Vds=drain source voltage, Vth=threshold voltage of P4, Rog consists of a resistance of a bonding wire and a contact resistances, such as from a few 10 milliohmns to 200 milliohms, for instance.

In FIG. 14, a curve 145 indicates the output voltage drop under load current, when Rog=50 milliohms. It shows a 10 millivolts drop at 200 milliamps load current.

D. Simulated Example of the Prior Art

FIG. 5 and FIG. 6 illustrate simulated gain phase characteristics and PSRR curve set of the prior art voltage regulator in FIG. 2. Curves 51, 52, 53 show the open loop gain characteristics and curves 54, 55, 56 show the phase delay between the input Vin and the output signal. Curves 61, 62, 63 show the PSRR characteristics. The curves 51, 54, 61 indicate the simulation results, when the operation current is sufficient over 100 uA, for instance. The curves 52, 55, 62 indicate the simulation results when the operation current is around 2 uA, for instance. A phase margin is generally used to express the stability of an amplifier, it is defined as a phase angle difference from 180 degrees delay at the unity gain frequency or 0 dB gain frequency. It is said that the phase margin of more than 40 degree means good stability without oscillation. A gain margin is used as an indicator of the stability. It is defined as a gain loss from the unity gain at the frequency with a 180 phase delay. It is said that the gain margin of more than minus 12 dB means good stability without oscillation. Hereinafter is presented a review on the phase margin for the voltage regulator.

The phase curve 54 shows that it has about 50-degree phase margin at the unity gain frequency of 400 Khz indicated by the curve 51, which is sufficiently marginal. The PSRR curve 61 indicates about −90 dB at the frequency of 10 Khz, which shows sufficiently good PSRR performance.

On the other hand, the phase curve 55 shows that it passes 180 degrees at the unity gain frequency and has no phase margin. Because the gain curve 52 still has 40 dB at the 180-degree frequency of the phase curve 55, the circuit will be in oscillation around the 180-degree frequency. After all, the prior circuit has at higher gain, inevitably a larger phase rotation and may turn to be unstable, when the operation current is merely decreased.

Simulated curve 53, 56, and 62 are corresponding to the case, where the output capacitance C3 increased to 100 uF under the condition of an operation current around 2 uA. Due to the enlarged C3 capacitance, the 3rd pole frequency comes down to a few Hz, where the gain curve 53 starts to drop off, and the voltage gain is smaller than in case of the curve 52 by about 20 dB. The 2nd zero-frequency is moved also downward about a few 10 Khz, as shown by the curve 56, to restrict the phase delay for improved stability. The phase curve 56 shows 50 degrees phase margin at the frequency where the curve 53 crosses the unity gain or 0 dB. Thus, even the prior circuit can achieve enough stability under the condition of very low operation current, however, the PSRR becomes very poor as indicated in FIG. 6. The curve 62 in FIG. 6 shows around 40 db degradation from the curve 61 at 10 Khz frequency.

The curve 63 shows the PSRR characteristic of another prior circuit modified from the circuit in FIG. 2. The circuit is composed of 1-stage amplifier and has no $2^{nd}$ stage. Therefore, insufficient voltage gain results in poor PSRR performance.

After all the prior voltage regulator cannot attain a very high PSRR such as −90 dB at 10 Khz under low current operation.

E. Summary on the Prior Arts

There are many patent proposals to achieve high power supply rejection to meet with increasing market demands for cellular phones and wireless LANs. They are classified in five broad categories as follows.

(1) Buffer pre-driver and pole splitting with extra amplifiers.

U.S. Pat. No. 5,631,598, U.S. Pat. No. 6,304,131

(2) Applying self-regulated voltage to a reference generator and an error amplifier.

U.S. Pat. No. 5,889,393

(3) Adaptively controlled pole location depending on output current.

U.S. Pat. No. 6,246,221

(4)Ripple filtering. U.S. Pat. No. 5,130,579, U.S. Pat. No. 4,327,319

(5) Ripple noise canceling with an inductive-transformer. U.S. Pat. No. 5,668,464

The category (1) includes an increasing number of proposals. In this category, a pre-buffer drives a power transistor so that poles are set far away from each other. Even though the power supply ripple rejection is excellent, extra amplifiers consume additional operation current. Furthermore, basically prior design theory is applied thereby. Therefore, operation current cannot be decreased to secure stability.

In the category (2), a voltage regulator is operated under regulated voltage. It must employ a start-up circuit and a level shift circuit for an output buffer transistor that constantly consume extra operation current. The start-up circuit requires more components and sometimes delays the transient response of the output, which is not suitable for an intermittent operation system.

The voltage regulator in the category (3) has an adaptive feedback loop from the output load current to the error amplifier to modify the operation bias current or to control a compensation time constant for stability improvement. A problem is caused by the feedback loop from the noisy output current, which requires expensive filtering. And the noisy current feedback affects the power supply rejection ratio. Another problem is caused by positive feedback from the output load current. The instability appears inevitably around the transition between the low bias and the boost bias regions.

The category (4) applies a filter having a large time constant to cover the very low frequency band. Such a filter is not feasible in monolithic silicon integration without cost sacrifice.

The category (5) employs an inductive-transformer which is also impossible to be integrated in a silicon chip. Thus, the categories (4) and (5) are suitable for hybrid fabricated power supply regulators or a discrete assembly, but not for silicon integration.

It is estimated that a few billions of equipments are worldwide in use. If one voltage regulator circuit draws 200 uA for instance, the total idling current, multiplied by 5 billion sets, reaches 1,000,000 ampere. If an operation voltage is assumed to be 3 Volt, the total power consumption reaches to 3,000 KW, which is equivalent to a small power plant capacity. The aim of the present invention is to reduce the current consumption of voltage regulators drastically to contribute to energy saving on a global scale.

SUMMARY OF THE INVENTION

The present invention is directed to a new voltage regulator and a design theory for achieving a very high PSRR performance with a low operation current and a high load regulation.

A novel voltage controlled current feedback circuit is proposed that can generate a reference voltage with a negative polarity with regard to the supply voltage for a better PSRR performance and with a positive polarity with regard to the load current for high load regulation.

The presented invention attains a high PSRR performance without a high gain error amplifier that may cause instability in the voltage regulator.

The voltage regulator is comprised of:

a first power supply terminal and a second power supply terminal;

a reference voltage generator to provide a reference voltage; a output buffer generating regulated voltage controlled by an error amplifier;

a voltage divider to provide a feedback voltage;

a voltage regulator having a voltage controlled current feedback connected to the reference voltage generator and the error amplifier;

the voltage controlled current feedback inversely decreases a feedback current according to an increment of the first supply voltage to decrease the reference voltage, or the voltage controlled current feedback decreases the feedback current according to a decrement of the load current of the output buffer to increase the reference voltage.

DESCRIPTION OF THE PREFERRED EMBODIMENT

Figure 7:
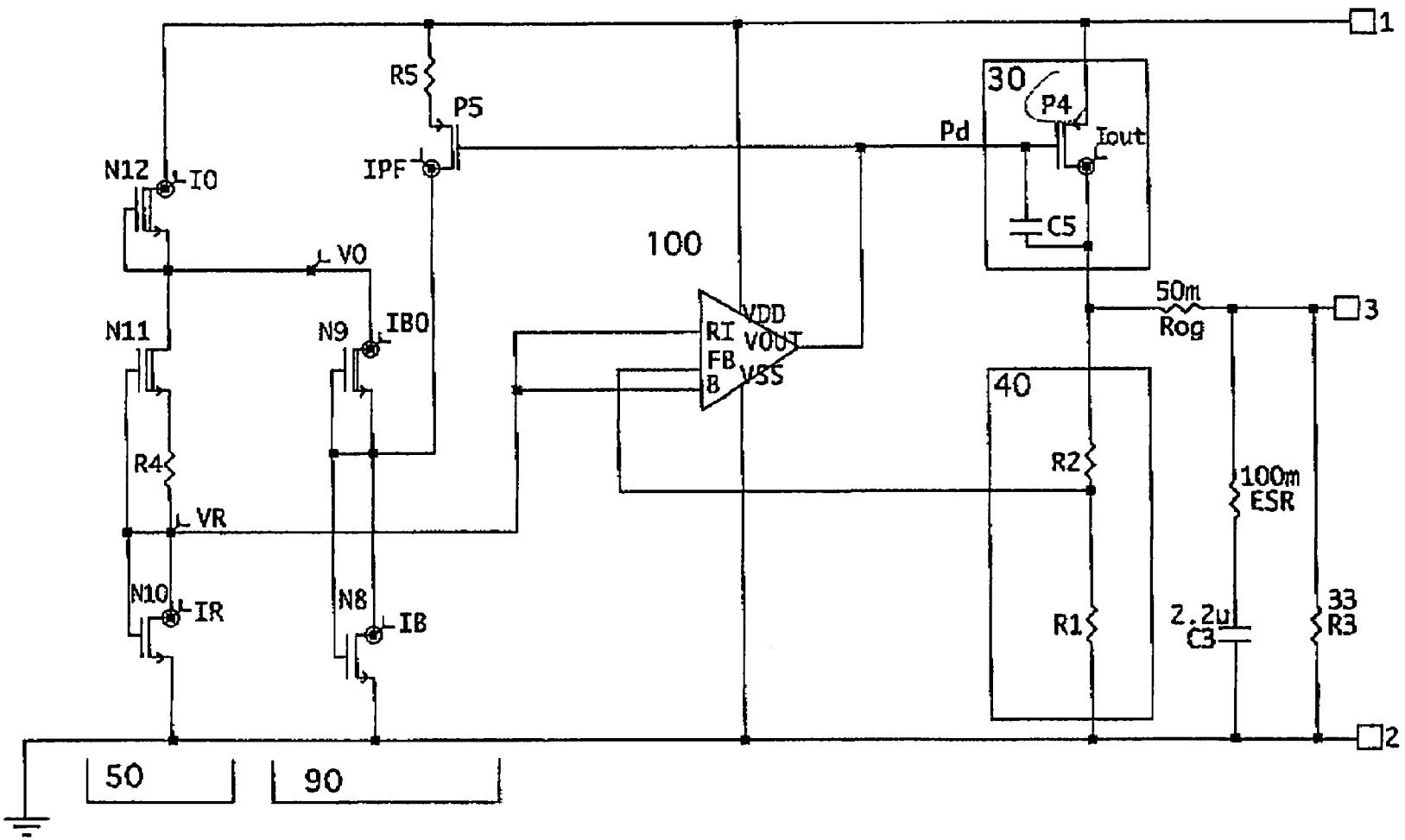
FIG. 7 is a circuit diagram showing an embodiment of the present invention.
Figure 15:
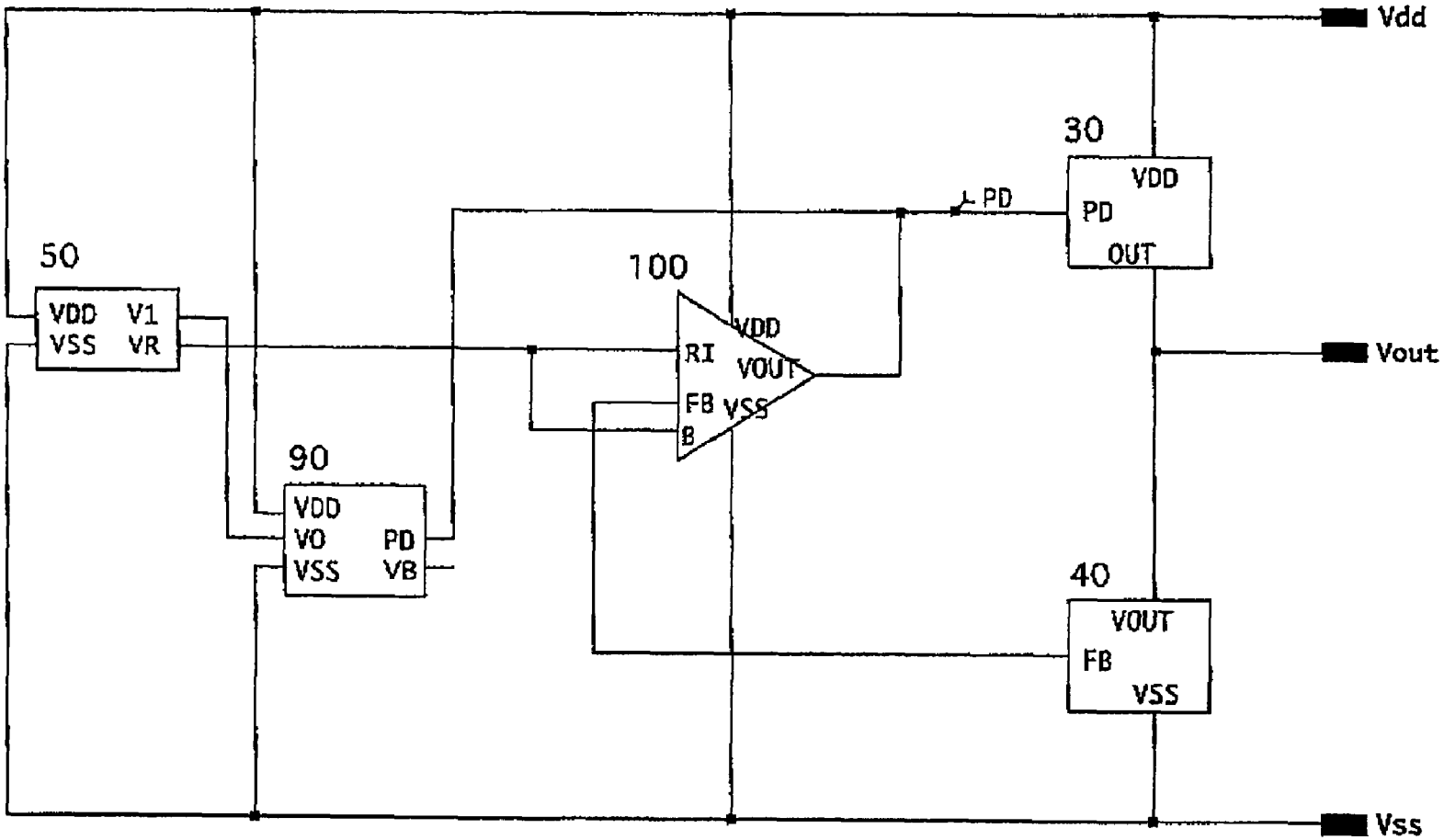
FIG. 15 is a block diagram showing an embodiment of the present invention.
Figure 16:
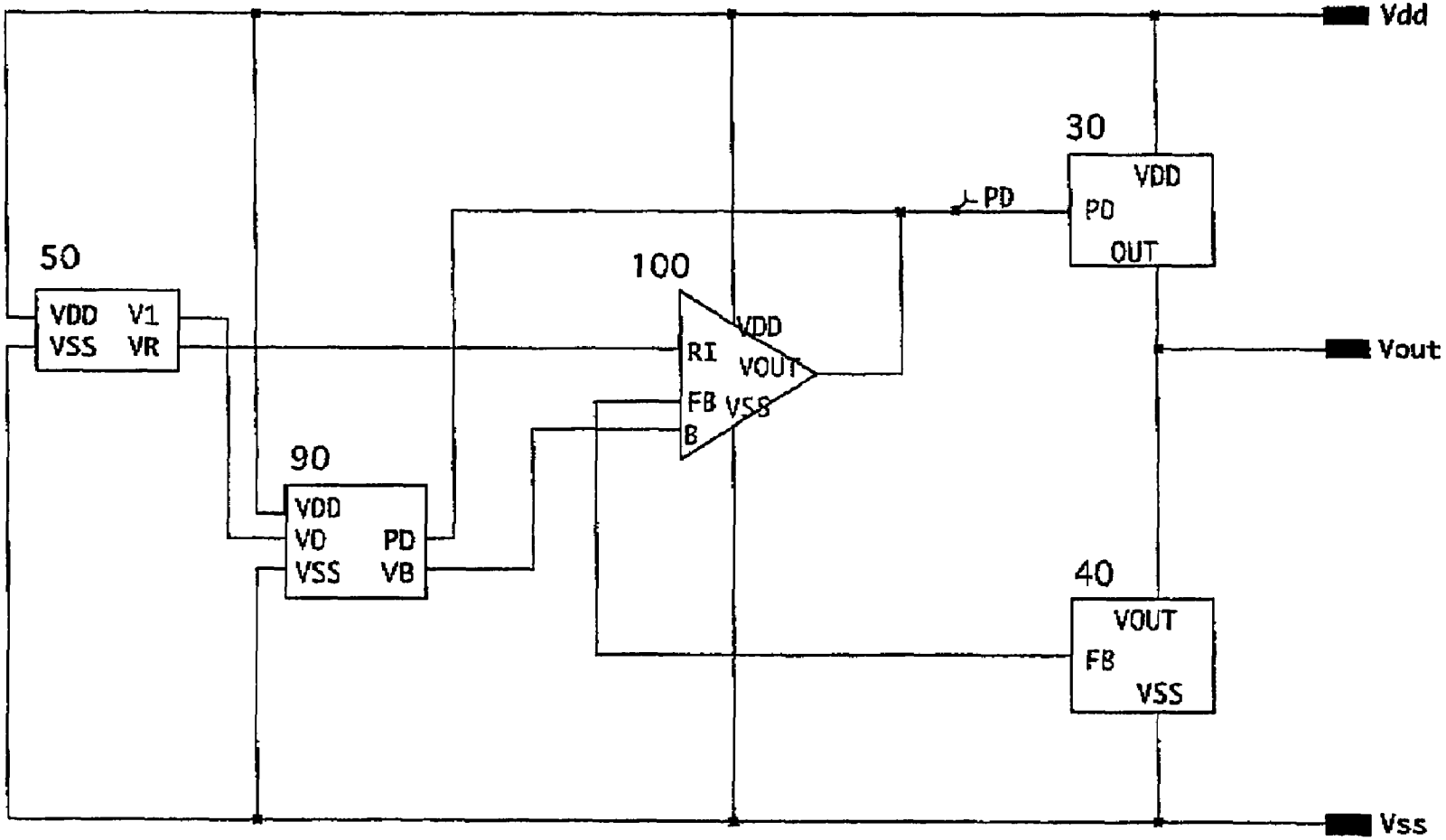
FIG. 16 is a block diagram showing a second embodiment of the present invention.

FIG. 15 is a block diagram showing an embodiment of the present invention, while FIG. 7 shows a circuit diagram of the embodiment of the present invention.

Figure 1:
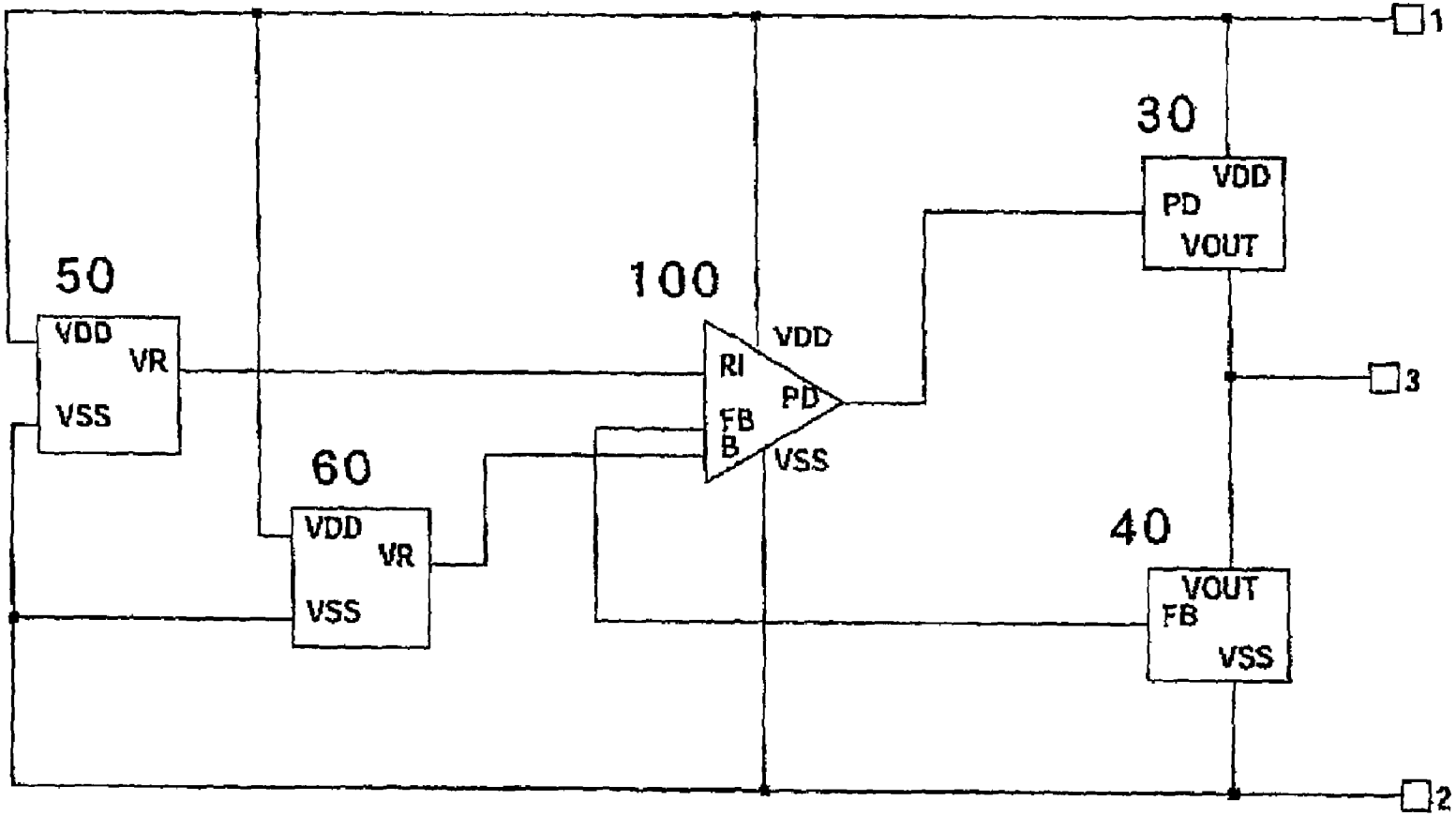
FIG. 1 is a block diagram showing a prior voltage regulator circuit.
Figure 2:
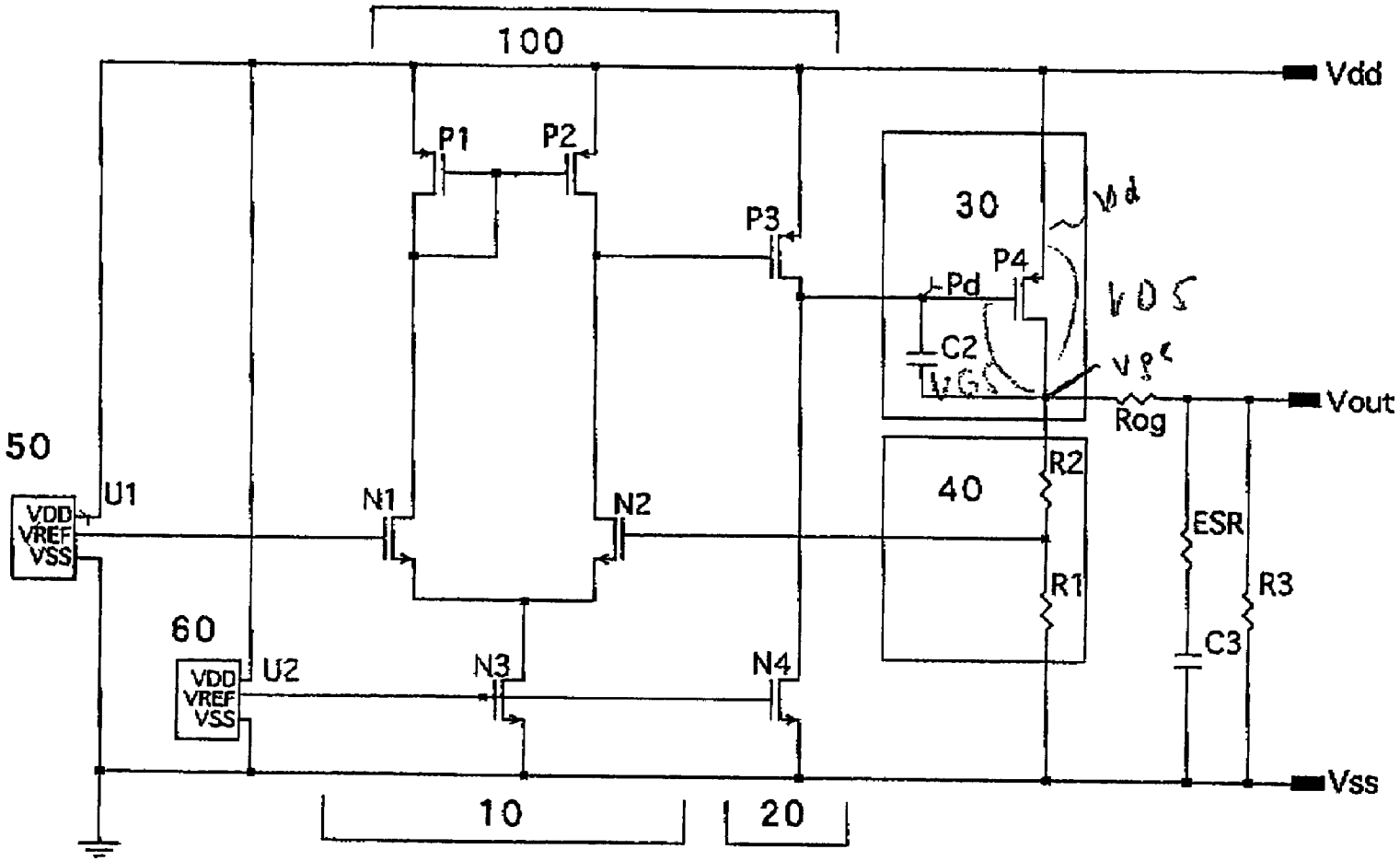
FIG. 2 is a circuit diagram showing a prior voltage regulator circuit.
Figure 3:
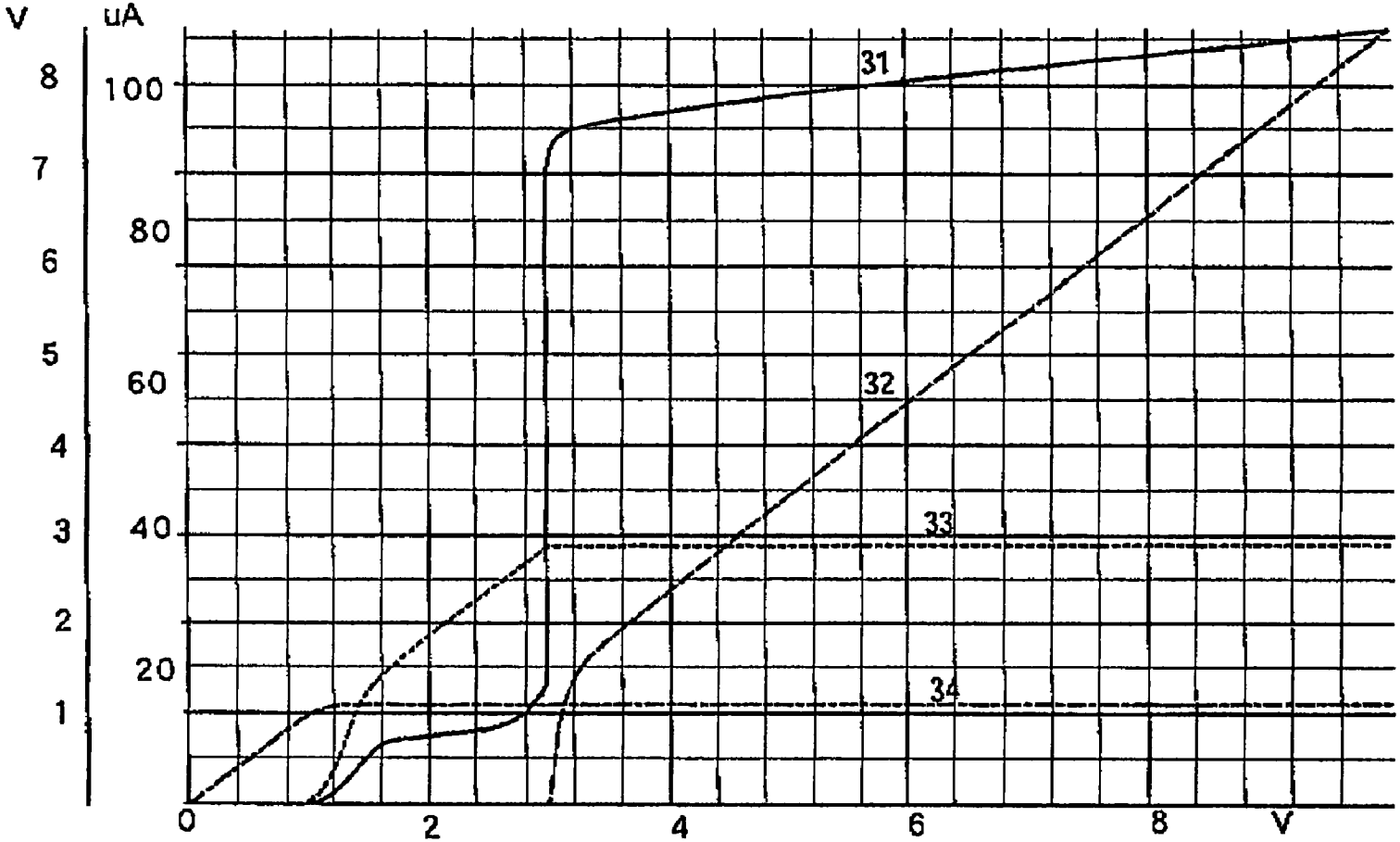
FIG. 3 is a graph showing DC characteristics of the prior art.
Figure 4:
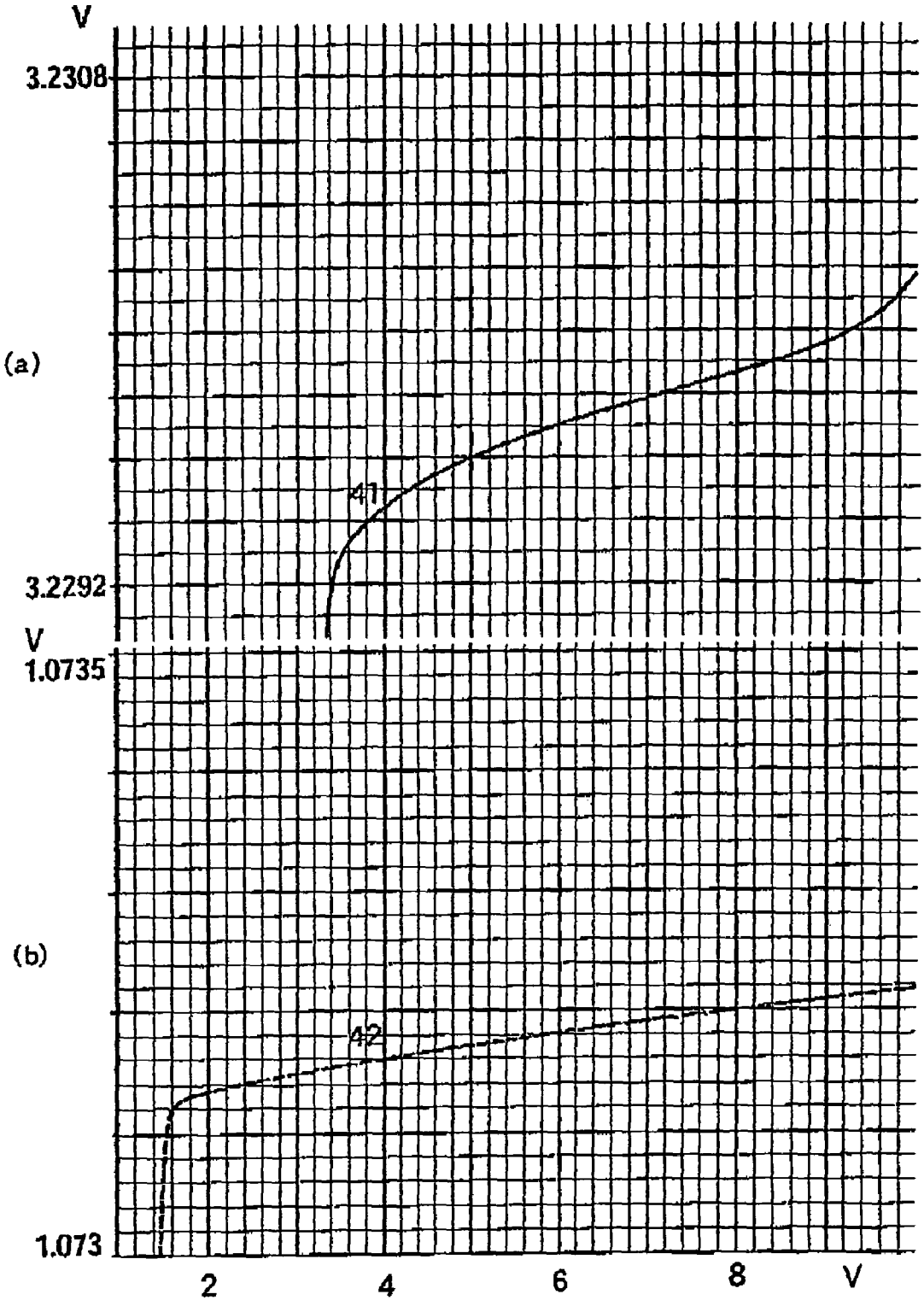
FIG. 4 is a graph showing DC characteristics in an expanded scale compared to FIG. 3.
Figure 5:
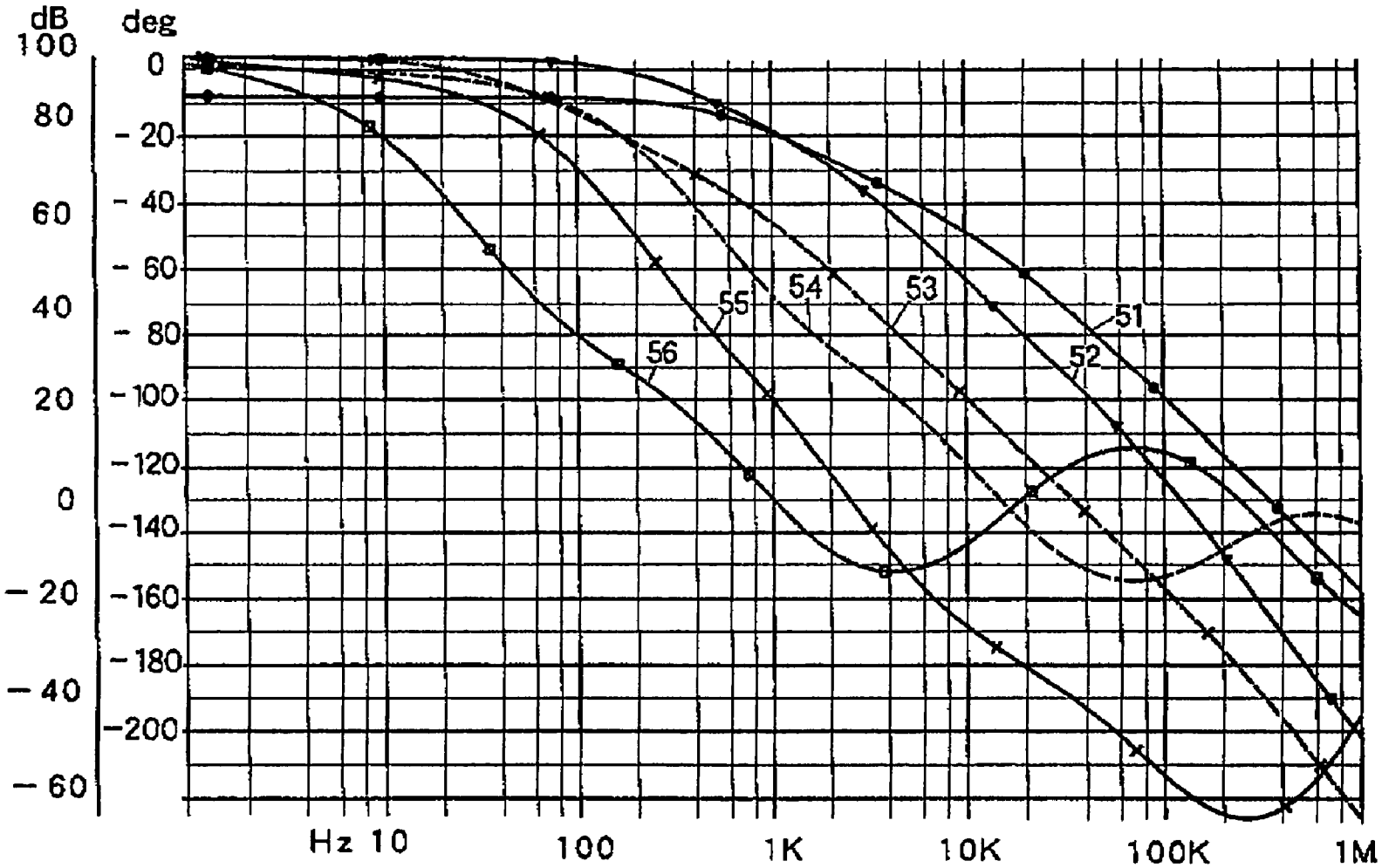
FIG. 5 is a graph showing gain phase curves vs. frequency.
Figure 6:
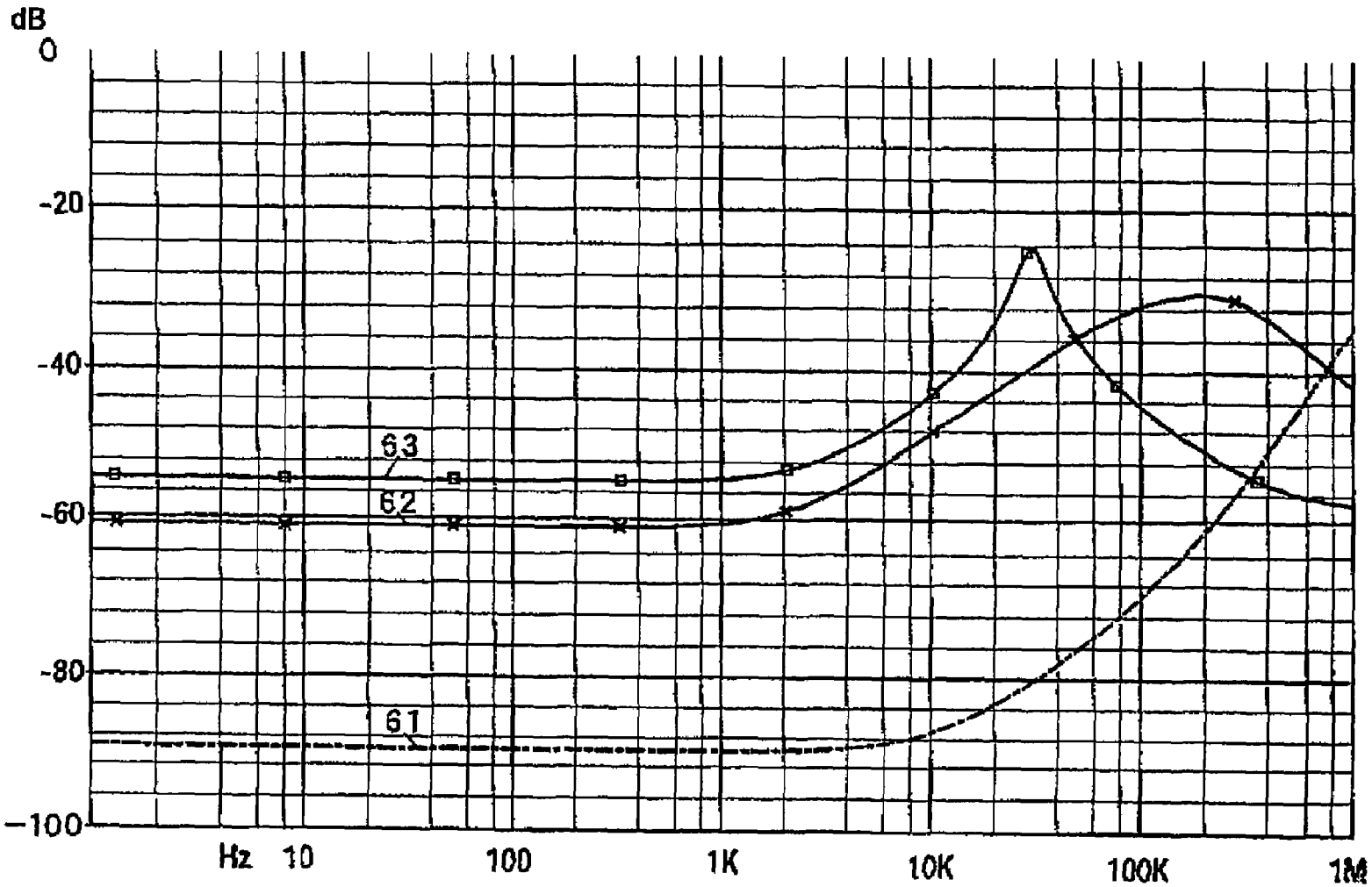
FIG. 6 shows PSRR frequency curves of the prior art.
Figure 8:
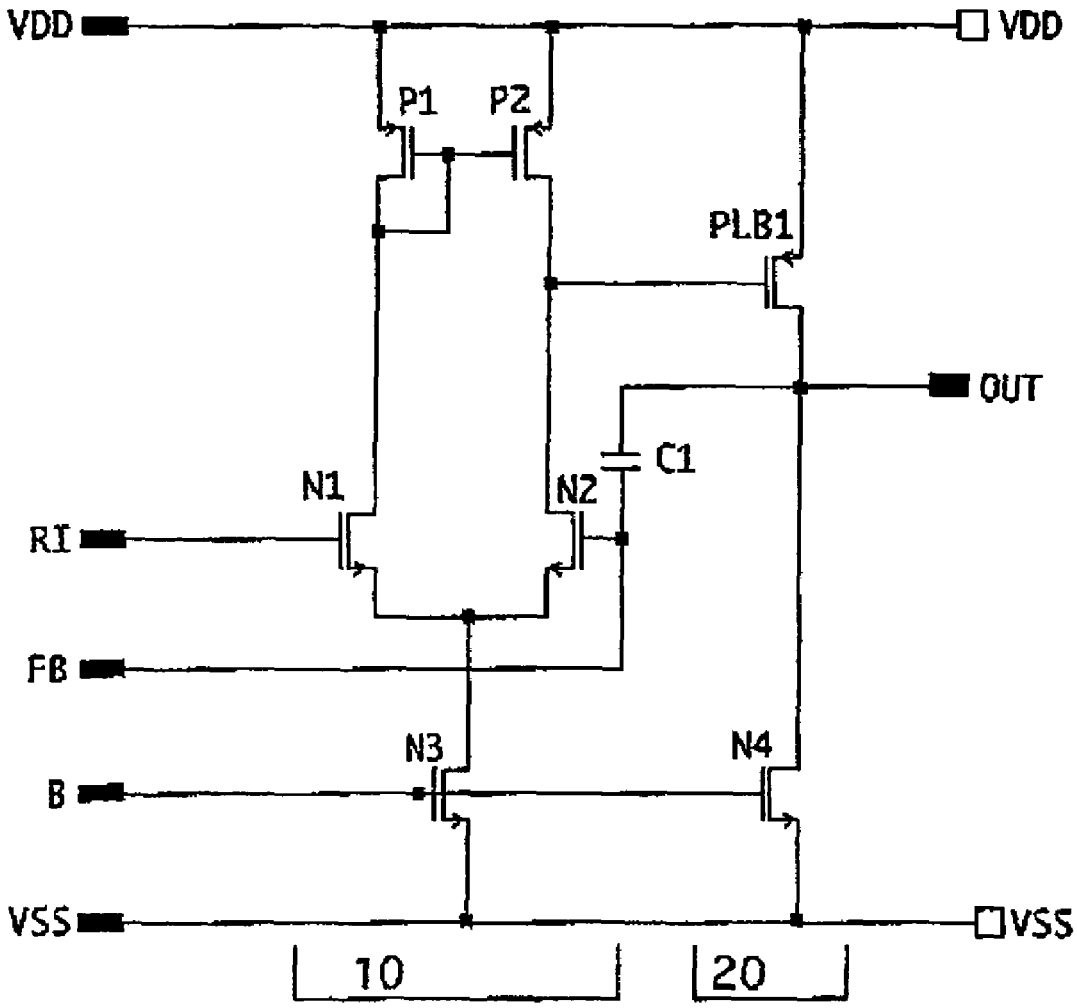
FIG. 8 is a circuit diagram showing the 2-stage error amplifier of the present invention.
Figure 9:
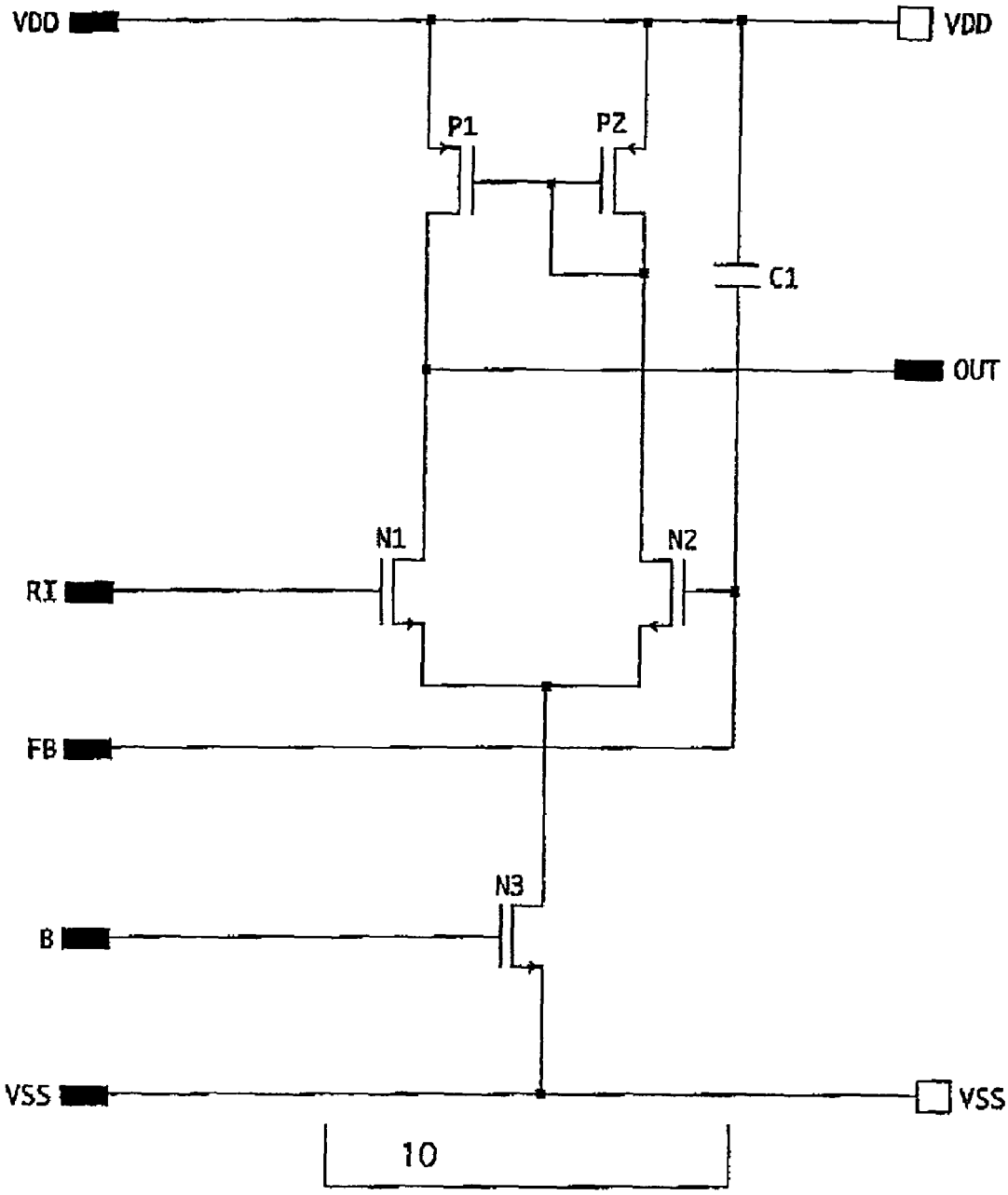
FIG. 9 is a circuit diagram showing the 1-stage error amplifier of the present invention.

In FIG. 7, the error amplifier block 100 is a two-stage amplifier, and FIG. 8 shows an example thereof, consisting of a first-stage amplifier 10 and second stage amplifier 20 for phase inversion. FIG. 9 shows another circuit example of the error amplifier 100, comprising a single stage differential amplifier 10. In FIG. 7, the voltage regulator comprises an output buffer 30, a voltage divider 40 and a reference voltage generator 50 as in case of the prior voltage regulator in FIG. 2. One difference of voltage regulator in FIG. 7 from the prior art is that a voltage controlled current feedback 90 is connected to the voltage reference generator 40 and the error amplifier 100.

Figure 10:
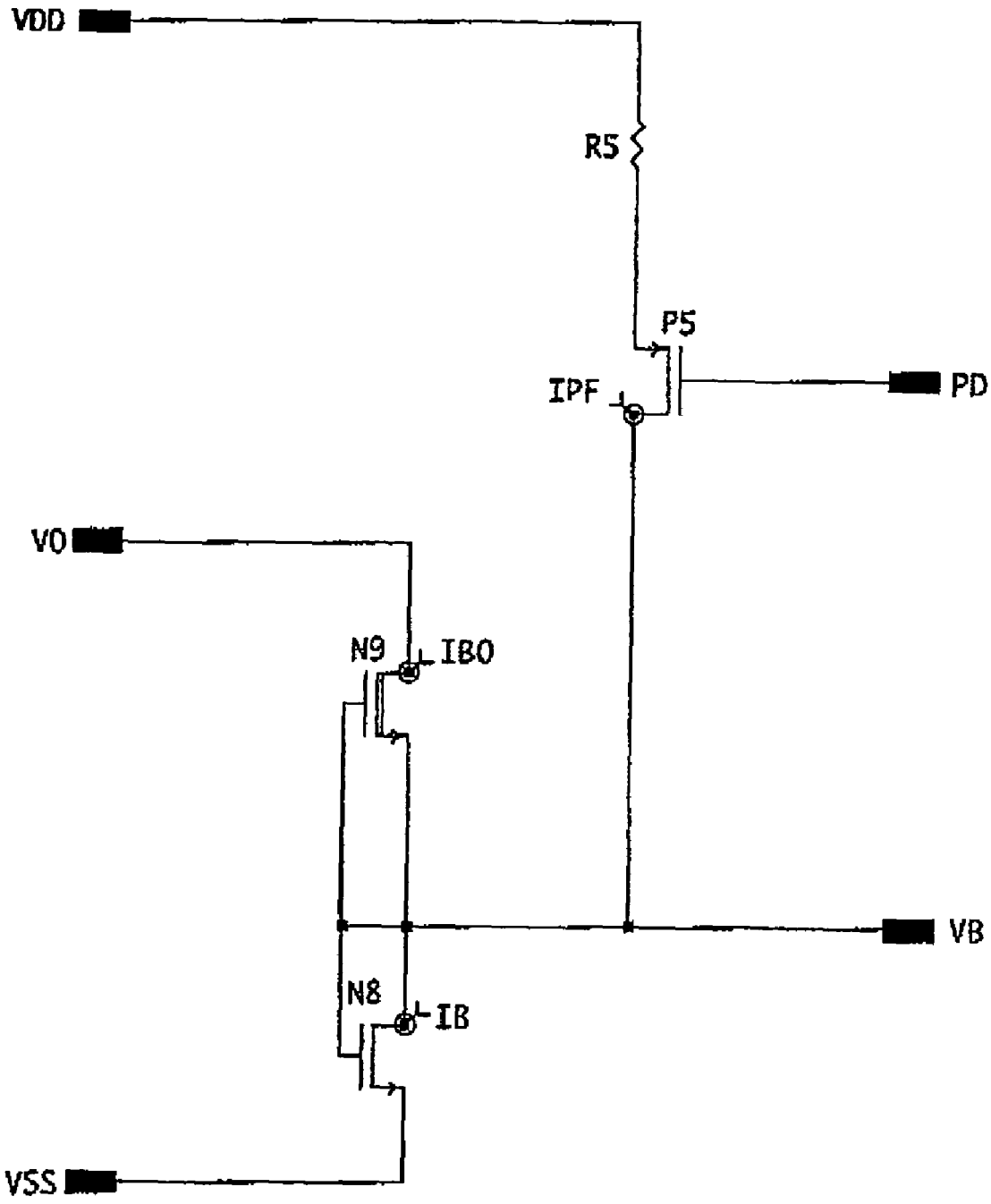
FIG. 10 is a circuit diagram of the voltage control current feedback of the present embodiment.

FIG. 10 shows a circuit diagram of the voltage controlled current feedback 90 that consists of a PFET P5 converting voltage to current, a current limiting resistor R5, an NFET N8, the drain current of which is indicated with IB, and a depletion NFET N9, the drain current of which is indicated as IB0. An FET can substitute the current limiting resistor R5. The drain current of P5 IPF flows into the NFET N8, which results in an increment of the drain potential of N8 shown as VB. When the IPF changes, the drain potential VB is modified and the drain current of N9 IB0 is modified, too.

Figure 11:
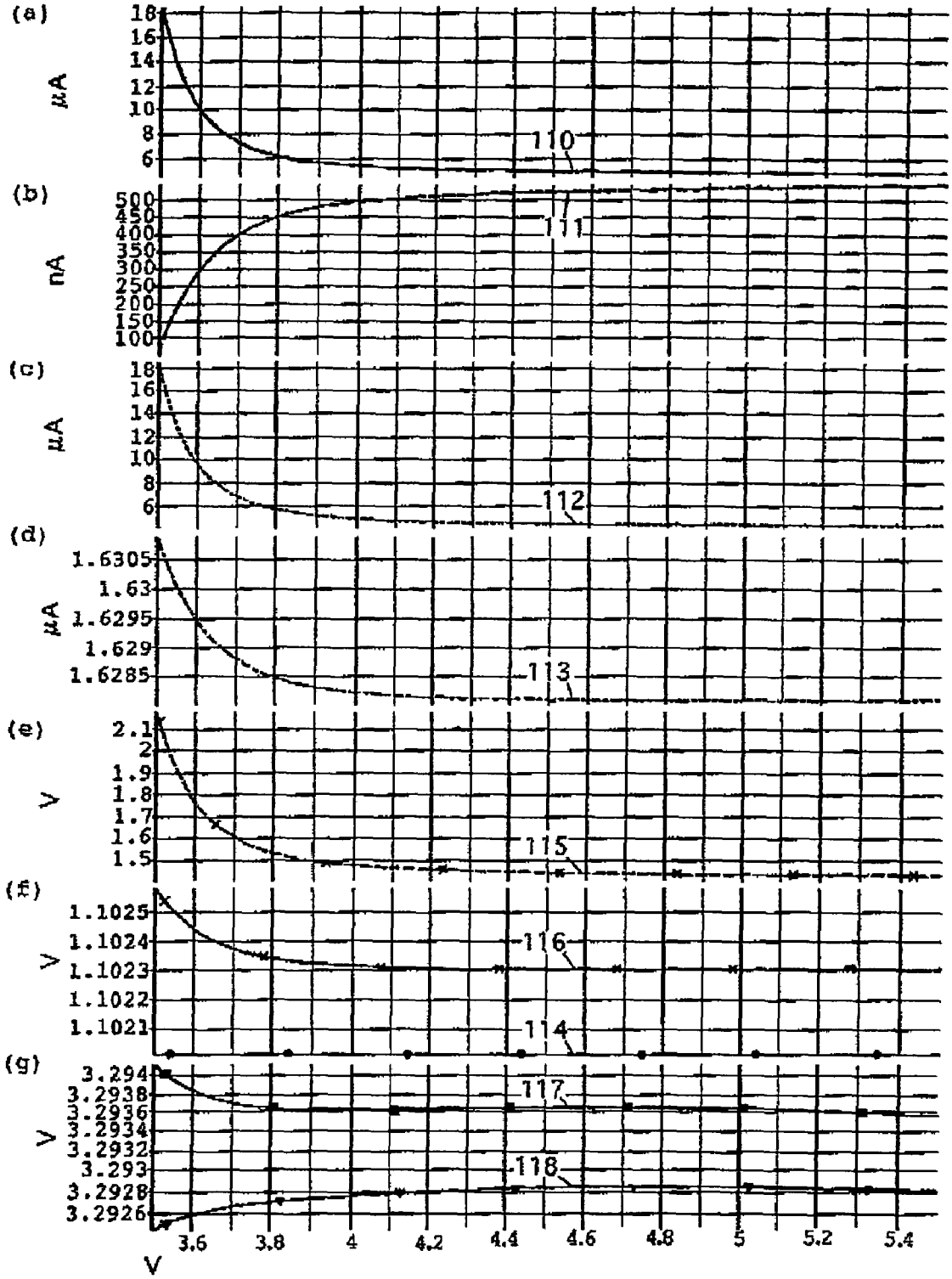
FIG. 11 is a graph showing the supply voltage dependency of the circuit in FIG. 7.
Figure 12:
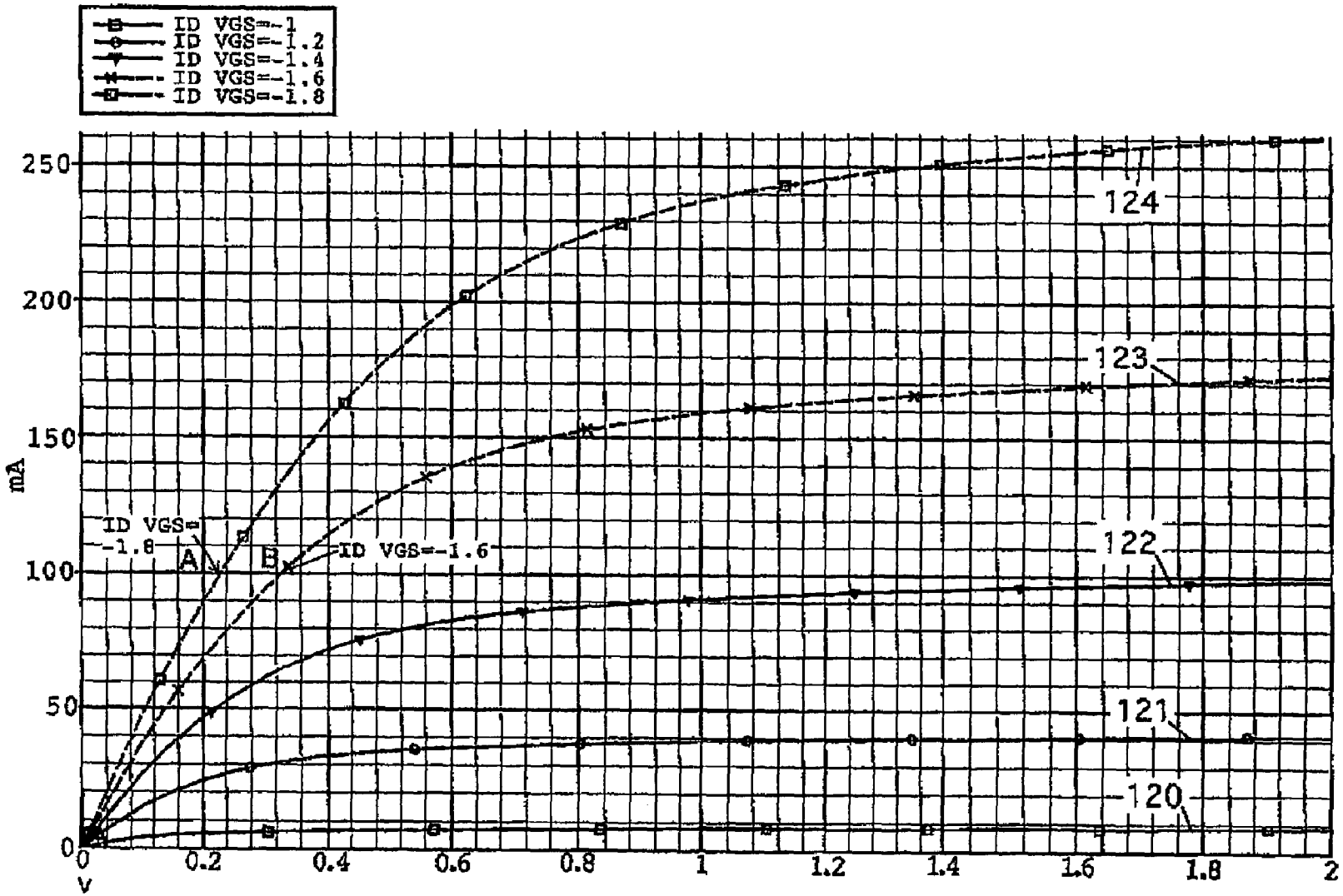
FIG. 12 is a graph showing the drain current curve and the drain voltage of a PFET P4 in FIG. 7.

FIG. 11 is a graph showing supply voltage dependency of the circuit in FIG. 7, assuming that the load current of the output buffer is constant. In FIG. 7 the gate node of PFET P4 is shown as "PD". In FIG. 15, the curve 115 indicates a voltage difference between the source potential and the potential of the node PD or the gate potential that goes down as the supply voltage Vdd goes up. Because a MOS FET has the feature that the drain current or the conductance increases as the drain voltage goes up under a constant gate voltage, this feature becomes remarkable in the large drain current region of a minimum channel length FET. Therefore, the larger the drain voltage, the smaller the gate voltage for a fixed drain current. FIG. 12 shows the characteristics between the drain current and the drain voltage for various gate voltages to illustrate the foresaid feature. In FIG. 12 curves 120 through 124 show drain currents for gate voltage changed from −1.0 V to −1.8 V with a 0.2 V step. The point "A" shows drain current of 100 mA and a drain voltage of 0.23 V and a gate voltage of −1.8 V. The point "B" shows the same drain current as in case of point "A" and a drain voltage of 0.32 V and a gate voltage of −1.6 V. Then, a smaller gate voltage and a larger drain voltage for the point "B" can result in the same drain current as in case of point "A". In other words, when the drain current is fixed, the gate voltage goes down, if the drain voltage goes up. However, in a high drain voltage region, drain currents are suppressed and the slope of the drain currents becomes gently and the gate source voltage-drop, shown by 115 in FIG. 11, falls smoothly.

To summarize the above, the following may be noted:

(1) When the supply voltage Vdd increases, the gate-source voltage of P4 or Vdd-PD voltage gap 115 falls.
(2) Decreasing the gate-source voltage of P5, tied to the gate of P4, the drain current of P5 IPF goes down.
(3) Smaller IPF current pushes the impedance of P5 higher, while the drain voltage of N8 VB falls.
(4) The drain voltage VB drop is added on the source-drain voltage of N9 to increase the drain current IB0 shown as 111 in FIG. 11.
(5) The current growth of IB0 draws more current from N12 as I0, that makes the drain voltage of N11 and N9 dropped.
(6) The voltage-drop at V0 decreases the current IR of N11, shown as 113 in FIG. 11.
(7) When the current IR decreases, the drain voltage of N10 or the reference voltage goes down.
(8) The reference voltage drop suppresses the output voltage 117 downward, even though the supply voltage rises.

Figure 13:
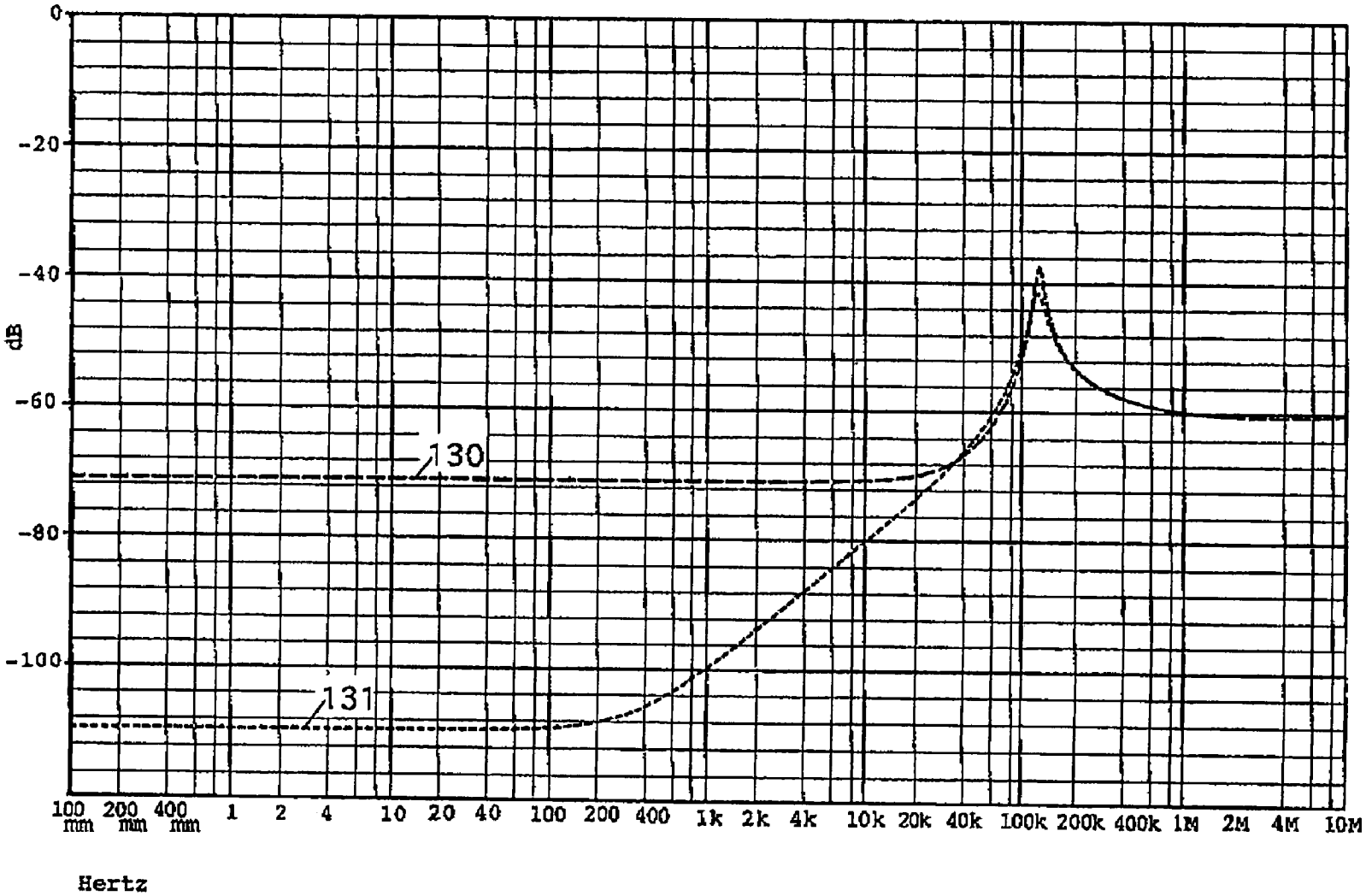
FIG. 13 shows PSRR frequency curves of the prior art.

Thus, the output voltage can be inversely controlled for the supply voltage increment. According to the aforesaid equation (2), a flat or negative slop for the output voltage with regard to the supply voltage is feasible, because the clause D(Vref) can have negative polarity in the invention. The angle of the curve 117 in FIG. 11, which shows the Vdd dependency of the output voltage, is defined by the feedback gain of the drain current IPF 112. The drain current IPF is determined by a channel length of P5, thus, the feedback gain is easily settable. In FIG. 11 the voltage reference 114 and the output voltage 118 show the DC characteristics, when the voltage controlled current feedback 90 is disabled. The reference voltage 114 increases slightly, seemingly flat due to the scale, similar to the conventional circuit, and the output voltage 118 increases, too. The slant of the output voltage curve with regard to the supply voltage equals to the PSRR figure at low frequency. FIG. 13 shows the PSRR curves 130 and 131 for the voltage controlled current feedback 90 disabled and enabled, respectively. The curve 131, corresponding to enabled case, indicates a better PSRR performance than the curve 130 by around 40 dB. The high PSRR curve 131 is achievable by the error amplifier having a low voltage gain. A high gain amplifier may cause the voltage regulator to become instable.

Any additional operation current is not required to attain this improvement.

As mentioned in the above, the drain current increment, caused by the drain voltage rise, is saturated in the high voltage region. The effect of the voltage controlled current feedback 90 is most sensitive just below the supply voltage being slightly higher than the output voltage by approximately 1 V. This feature is important because the supply voltage rage used commonly for battery-operated equipments is not far higher from the output voltage. A battery voltage is falling and reaching the output voltage, when an equipment is turned on. It is a desirable feature that the voltage regulator keeps good performances until just before battery life end for a longer battery life.

There is previously known no means to very minutely control the reference voltage. The present invention provides unprecedented means to modify the reference voltage minutely by a large channel length change that is not sensitive to the device dimension. The design theory is straightforward and mass-production is easy.

In the presented invention the high PSRR is achievable by the channel length of the voltage controlled current feedback 90, not by a high gain amplifier that may cause instability in the voltage regulator.

As a similar method following references are listed.

U.S. Pat. No. 6,522,111

U.S. Pat. No. 6,046,577

According to those references, the output voltage of the error amplifier is converted to current proportional to the output load current to feed for the operation current of the error amplifier. Those references show the traditional adaptive control circuits, where the major object is the improvement of the transient response. Any of those reference have no such feature as to achieve a reference voltage minute control. The present invention is distinguished from the traditional adaptive control methodology. The adaptive control is defined in a narrow sense as a control method by which the output response is accelerated by increasing feedback current proportionally to the output load current. In the presented invention, the output voltage is suppressed downward by decreasing feedback current in inverse proportion to the supply voltage.

Another Function of the Present Invention

Figure 14:
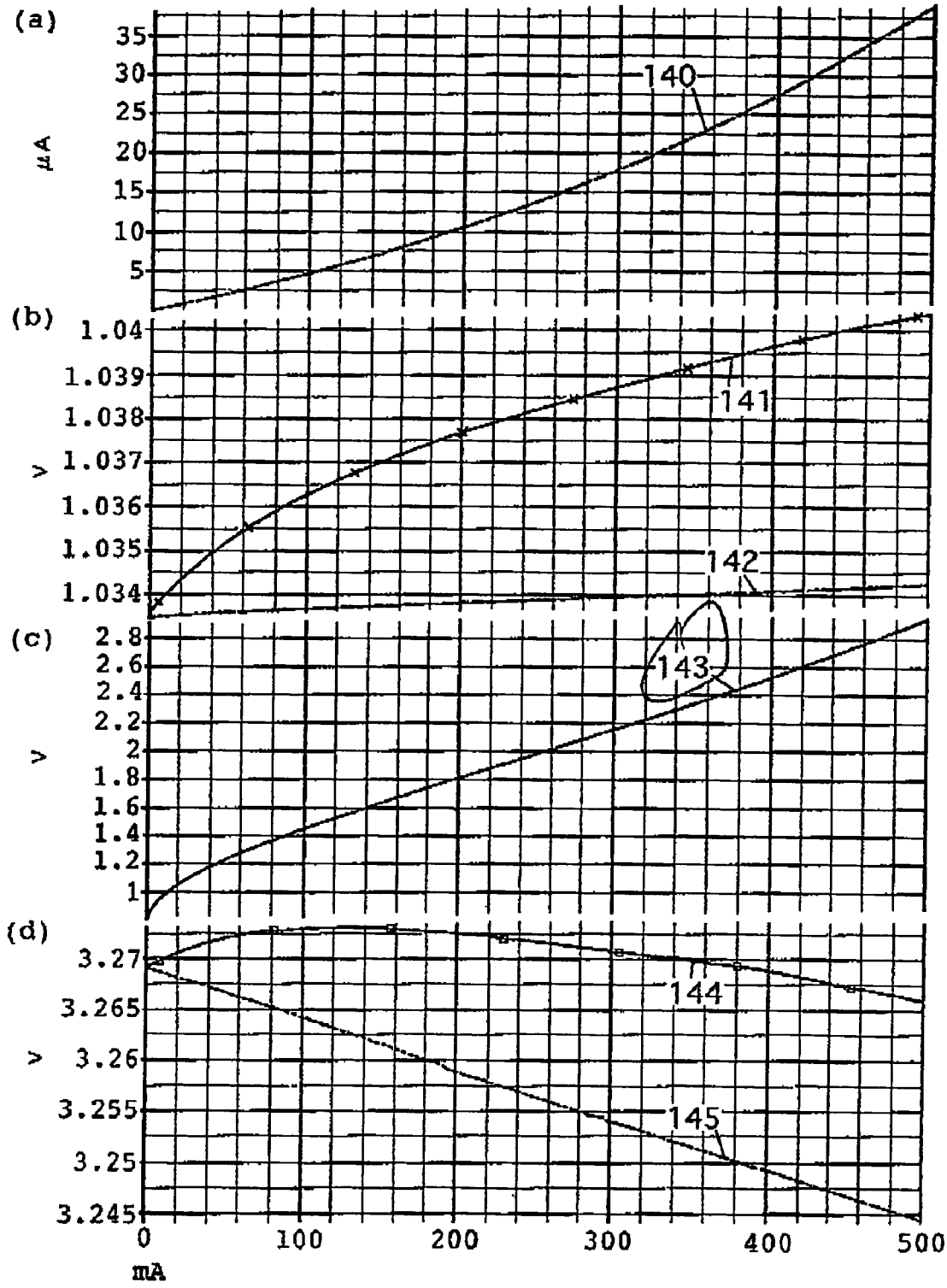
FIG. 14 shows a load regulation for the circuit in FIG. 7

As previously mentioned, the parasitic resistance of the output terminal degrades the load stability. Since the parasitic resistances is located outside the feedback loop of the voltage regulator circuit, the output voltage declines, depending on the load current. FIG. 14 illustrates the effect that the load stability is improved by one embodiment of the present invention. In the voltage regulator in FIG. 7, the supply voltage is constant; the load current is swept from 0 to 500 mA.

From FIG. 14 it can be summarized:

(1) When the load current Iout, indicated on the horizontal axis, increases, the gate-source voltage of P4 or the voltage gap 143 between Vdd and PD rises.

(2) Increasing the gate-source voltage of P5, tied to the gate of P4, the drain current of P5 IPF 140 goes up.

(4) Larger IPF current 140 causes the impedance of P5 to decrease, and then the drain voltage of N8 VB to rise.

(5) The drain voltage VB rise is subtracted from the source-drain voltage of N9 to decrease the drain current IB0.

(6) The current decrement of IB0 draws less current from N12 as I0, that makes the drain voltage of N11 and N9 rise.

(7) The voltage increment at V0 raises the current IR of N11.

(8) When the current IR increases, the drain voltage of N10 or the reference voltage 142 goes up.

(9) The reference voltage 142 increment pushes the output voltage 144 upward even though the load current rises.

Thus, the output voltage can be boosted inversely for the load current increment. It is a desirable function for a voltage regulator that the voltage controlled current feedback 90 compensates voltage drop caused by the load current increment. The compensation extent is defined with the feedback current IPF which is straightforwardly settable by the channel length of PFET P5. Curves 142 and 145 show the reference voltage and the output voltage, respectively, when the voltage controlled current feedback 90 is disabled. As shown in FIG. 14, the output voltage 145 is linearly declined and the reference voltage 142 is flat and shows no variation.

In FIG. 14, the reference voltage 141 increases non-linearly but not saturated, however, its increment will become saturated in case of a large channel length of the PFET P5.

The present invention provides a high PSRR performance and an excellent load regulation without any extra operation current of the error amplifier by providing the new voltage controlled current feedback 90. The voltage controlled current feedback 90 does not cause any disturbances to the stability of the error amplifier. Since poles and zeros of the voltage regulator are substantially not affected the error amplifier, the output buffer and the voltage divider are also not subject to change. By adding the voltage controlled current feedback 90, although the total operation current of the voltage regulator increases very slightly, the outcome is extremely large. The drastic performance improvement far surpasses the very little chip area enlargement and the increase of costs.

The present invention is not limited to the embodiments shown in the figure, and covers also further embodiments that apply an equivalent mode of inversion not deviating from the concept of the disclosed invention. "FET" means not only the MOS type, but also the function type, TFT and GaAs type. Every kind of FET is applicable to the present invention. Furthermore, it is within the scope of the present invention to apply an N-Type input error amplifier, P-type input, etc.

What is claimed is:

1. Voltage regulator having an inverse adaptive controller comprising;

a first power supply terminal and a second power supply terminal;

a reference voltage generator to provide a reference voltage;

a output buffer generating regulated voltage controlled by an error amplifier;

a voltage divider to provide a feedback voltage; and a voltage regulator having a voltage controlled current feedback connected to said reference voltage generator and said error amplifier;

wherein said voltage controlled current feedback decreases a feedback current inversely with regard to an increment of the said first supply voltage to decrease the reference voltage.

2. Voltage regulator having a inverse adaptive controller comprising;

a first power supply terminal and a second power supply terminal;

a reference voltage generator to provide a reference voltage;

a output buffer generating regulated voltage controlled by an error amplifier;

a voltage divider to provide a feedback voltage; and a voltage regulator having a voltage controlled current feedback connected to said reference voltage generator and said error amplifier;

wherein said voltage controlled current feedback decreases a feedback current with regard to a decrement of the load current of said output buffer to increase the reference voltage.

* * * * *